US005783912A

United States Patent [19]

Cocoma et al.

[11] Patent Number: 5,783,912

[45] Date of Patent: Jul. 21, 1998

[54] ELECTRODELESS FLUORESCENT LAMP HAVING FEEDTHROUGH FOR DIRECT CONNECTION TO INTERNAL EMI SHIELD AND FOR SUPPORTING AN AMALGAM

[75] Inventors: John Paul Cocoma, Clifton Park; William Newell Schultz, Niskayuna; Michael Patrick Dennin, Watervliet; William Joseph Jones, Altamont, all of N.Y.

[73] Assignee: General Electric Company, Schenectady, N.Y.

[21] Appl. No.: 672,490

[22] Filed: Jun. 26, 1996

[51] Int. Cl.[6] ..... H01J 61/36; H01J 65/00; H01J 61/24

[52] U.S. Cl. ..... 315/248; 315/344; 313/490; 313/493; 313/550; 313/565

[58] Field of Search ..... 315/248, 344; 313/493, 545, 550, 490, 492, 313, 565

[56] References Cited

U.S. PATENT DOCUMENTS

| | | | |
|---|---|---|---|
| 4,568,859 | 2/1986 | Houkes et al. | 315/248 |
| 4,940,923 | 7/1990 | Kroontje et al. | 315/248 |
| 5,412,288 | 5/1995 | Borowiec et al. | 315/248 |
| 5,412,289 | 5/1995 | Thomas et al. | 315/248 |
| 5,434,482 | 7/1995 | Borowiec et al. | 315/248 |
| 5,461,284 | 10/1995 | Roberts et al. | 315/57 |
| 5,500,567 | 3/1996 | Wilson et al. | 313/490 |
| 5,559,392 | 9/1996 | Cocoma et al. | 313/490 |
| 5,629,584 | 5/1997 | Borowisec et al. | 313/565 |
| 5,698,951 | 12/1997 | Maya et al. | 315/248 |

OTHER PUBLICATIONS

"Integrated Startup and Running Amalgam Assembley for an Electrodesless Fluorescent Lamp", Borowiec et al., Ser. No. 08/316,989, (RD–23931), filed Oct. 3, 1994.

"Amalgam Support Arrangement for an Electrodeless Discharge Lamp" Borowiec et al., Ser. No. 08/547,076 (RD–24395), filed Oct. 23, 1995.

*Primary Examiner*—Arnold Kinkead

*Attorney, Agent, or Firm*—Jill M. Breedlove; Douglas E. Stoner

[57] ABSTRACT

An electrodeless fluorescent lamp includes a feedthrough structure extending from the exterior to the interior of the lamp which is constructed of a suitable material, e.g., platinum or a combination of platinum and rhodium, for directly connecting an interior EMI shield to ground. The feedthrough is also suitable for supporting an amalgam flag.

10 Claims, 2 Drawing Sheets

ELECTRODELESS FLUORESCENT LAMP HAVING FEEDTHROUGH FOR DIRECT CONNECTION TO INTERNAL EMI SHIELD AND FOR SUPPORTING AN AMALGAM

FIELD OF THE INVENTION

The present invention relates generally to electrodeless fluorescent lamps and, more particularly, to an electrodeless fluorescent lamp having a feedthrough from the exterior to the interior of the lamp for providing a direct connection between an internal electromagnetic interference (EMI) shield and ground and for providing a suitable support for optimally positioning an amalgam in the lamp.

BACKGROUND OF THE INVENTION

Typical electrodeless fluorescent lamps have an optically transparent, electrically conductive coating, e.g., such as comprising fluoro-tin-oxide or indium-tin-oxide, on the interior surface of the lamp envelope, or bulb, to function as an EMI shield. To be effective, such an EMI shield must be connected to ground potential. In exemplary electrodeless fluorescent lamps having a reflective portion, such as sold under the trademark Genura™ by General Electric Company, a silver frit coating is employed on the exterior of the reflective portion of the bulb to capacitively couple the EMI coating to ground. Capacitive coupling in this manner is effective only if a large surface on the bulb is covered by an opaque reflector. Unfortunately, such a configuration is not compatible with A-line and globe style bulbs which do not have such large reflective portions. Furthermore, any change in bulb dimension or glass thickness can alter the EMI shielding in ways that are difficult to predict.

Accordingly, it is desirable to provide a direct connection from the EMI-shield coating to ground, thereby eliminating the need for a large silver frit capacitor. Such a connection is also desirable for applicability to lamps which do not have a large reflective portion, such as A-line and globe style lamps.

Another issue in electrodeless fluorescent lamp construction is controlling mercury vapor pressure therein. The optimum mercury vapor pressure for production of 2537 Å radiation to excite a phosphor coating in a fluorescent tamp is approximately six millitorr, corresponding to a mercury reservoir temperature of approximately 40° C. One approach to controlling the mercury vapor pressure in an electrodeless fluorescent lamp is to use an alloy capable of absorbing/releasing mercury from/into its gaseous phase in varying amounts, depending upon temperature. Alloys capable of forming amalgams with mercury have been found to be particularly useful. The mercury vapor pressure of such an amalgam at a given temperature is lower than the mercury vapor pressure of pure liquid mercury.

For starting a lamp, i.e., initiating the discharge, a starting amalgam is used such that the mercury is vaporized more quickly; therefore, higher light output is achieved more quickly. In exemplary electrodeless fluorescent lamps, an amalgam flag structure, e.g., comprising indium, is positioned near the vertical center of the lamp and near the wall of the re-entrant cavity. The amalgam flag is supported by a specially formed piece of wire which is inserted into the top of the exhaust tube prior to attaching the re-entrant cavity to the bulb. Unfortunately, this method of manufacture presents a clearance problem since the opening in the bulb must be large enough to accommodate the combined width of the re-entrant cavity and the amalgam flag.

Accordingly, it is desirable to provide an electrodeless fluorescent lamp configuration including a starting amalgam structure while solving the clearance problem during manufacture.

Preferably, it is desirable to solve both problems described hereinabove with a single structure that would enable a simple manufacturing process.

SUMMARY OF THE INVENTION

An electrodeless fluorescent lamp comprises a feedthrough structure extending from the exterior to the interior of the lamp which is suitably constructed for directly connecting an interior EMI shield to ground. The feedthrough is also suitable for supporting an amalgam.

In a preferred embodiment, the feedthrough comprises a platinum or platinum/rhodium wire which is sealed to a soda lime glass envelope by wetting the wire with either soda lime or lead glass. The wire feedthrough is inserted into the envelope before it is coated with an interior EMI shield comprising an optically transparent, electrically conductive coating.

BRIEF DESCRIPTION OF THE DRAWINGS

The features and advantages of the present invention will become apparent from the following detailed description of the invention when read with the accompanying drawings in which.

DETAILED DESCRIPTION OF THE INVENTION

Figure 1:
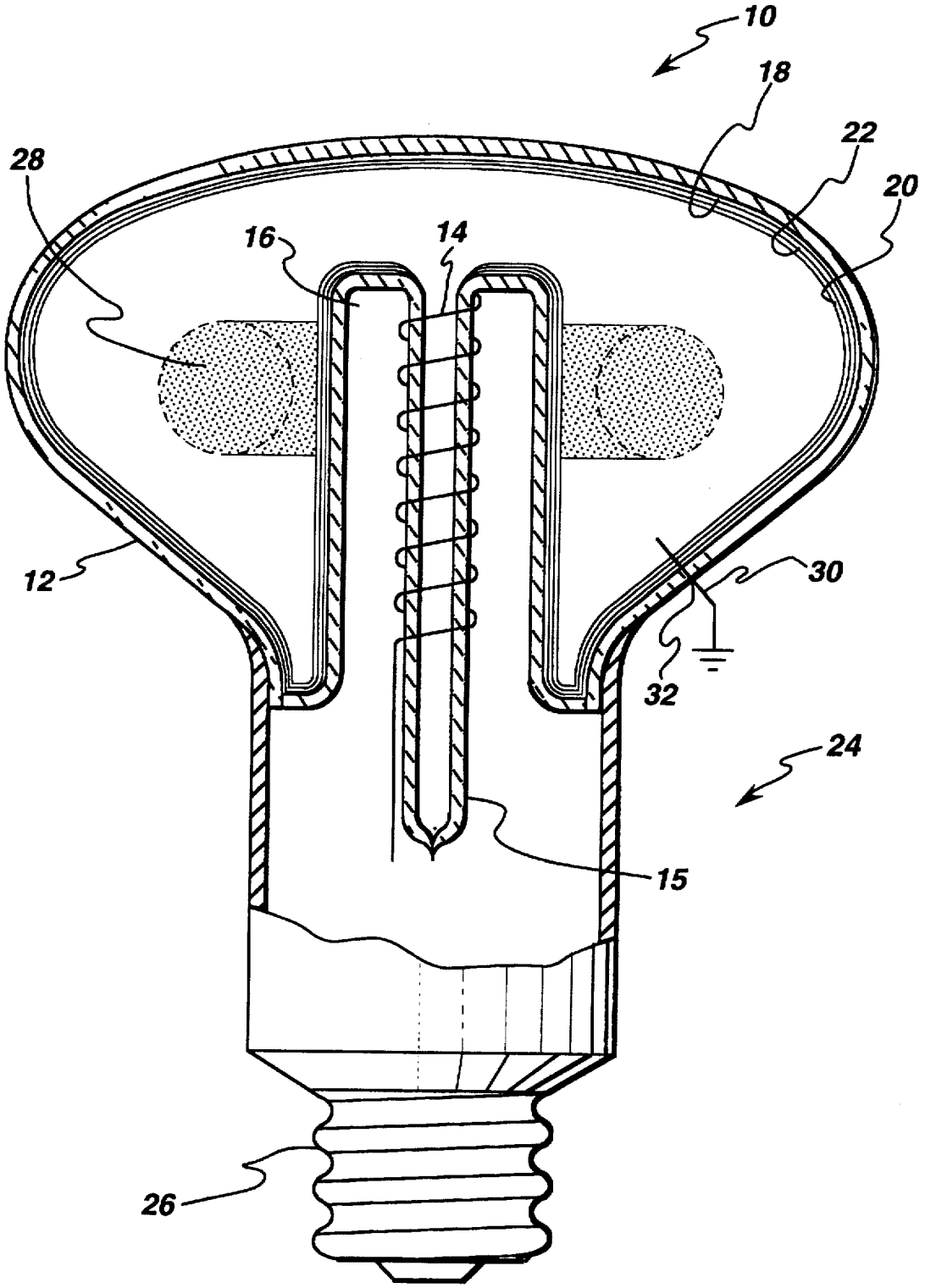
FIG. 1 illustrates, in partial cross section, an electrodeless fluorescent lamp having a feedthrough structure according to the present invention for directly connecting an internal EMI shield to ground.

FIG. 1 illustrates an electrodeless fluorescent discharge lamp 10 having an envelope, or bulb, 12 containing an ionizable gaseous fill. Envelope 12 is typically made of soda lime glass. Although the present invention is illustrated with reference to an electrodeless fluorescent lamp, the principles of the present invention apply equally to other types of electrodeless lamps which emit radiation having a wavelength in a range from approximately 100 nanometers (nm) to 1000 nm.

A suitable fill for the electrodeless fluorescent lamp of FIG. 1 comprises a mixture of a rare gas (e.g., krypton and/or argon) and mercury vapor and/or cadmium vapor. An excitation coil 14 is situated within, and removable from, a re-entrant cavity 16 within envelope 12. For purposes of illustration, coil 14 is shown schematically as being wound about an exhaust tube 15 which is used for filling the lamp. However, the coil may be spaced apart from the exhaust tube and wound about a core of insulating material or may be free standing, as desired. The interior surface of envelope 12 has an optically transparent, electrically conductive coating 18 for EMI shielding. A suitable EMI shield 18 may comprise fluoro-tin-oxide or indium-tin-oxide coating.

The interior surface of envelope 12 also has a suitable phosphor coating 20. Typically, a protective coating 22 of, for example, alumina is applied before the phosphor coating is applied in order to protect the phosphor from sodium leakage from the soda lime glass envelope 12.

Envelope 12 fits into one end of a base assembly 24 containing a radio frequency power supply (not shown) with a standard, e.g., Edison type, lamp base 26 at the other end.

In operation, current flows in coil 14 as a result of excitation by a radio frequency power supply (not shown).

As a result, a radio frequency magnetic field is established within envelope 12, in turn creating an electric field which ionizes and excites the gaseous fill contained therein, resulting in an ultraviolet-producing discharge 28. Phosphor 20 absorbs the ultraviolet radiation and emits visible radiation as a consequence thereof.

In accordance with the present invention, electrodeless fluorescent lamp 10 further comprises a feedthrough 30 for directly connecting EMI shield 18 to a ground potential. Feedthrough 30 preferably comprises platinum wire or platinum/rhodium wire. Wire comprising platinum is preferred for several reasons: soda lime readily wets platinum; platinum has a melting point well above typical working temperatures for soda lime glass (e.g., 700° C. to 1000° C.); and platinum has a thermal expansion rate compatible with that of soda lime glass.

According to a preferred method of manufacture, platinum (or platinum/rhodium) wire is initially wetted with either soda lime or lead glass. The coated platinum wire is then wetted to an opening 32 in envelope 12 to make a vacuum-tight seal. Then, the EMI shield 18 (e.g., fluoro-tin-oxide coating) is applied to the interior surface of the envelope.

In an alternative embodiment, the EMI shield is applied to the interior surface of the envelope before the wire is inserted and sealed to the envelope. To this end, platinum paste can be applied to the feedthrough and envelope at the location of the opening and then fired to connect the feedthrough to the existing EMI coating.

Feedthrough 30 is connected to radio frequency ground external to envelope 12 by any suitable means, such as, for example, a simple pressure connector since platinum is advantageously non-corrosive.

Advantageously, feedthrough 30 provides a direct connection between the interior EMI shield and ground, thereby avoiding the need for a large silver frit capacitor. As a result, the electrodeless fluorescent lamp configuration of the present invention is therefore not only compatible with reflector type lamps which can accommodate such large silver frit capacitors, but is also applicable to A-line and globe style lamps which cannot accommodate such capacitors.

Figure 2:
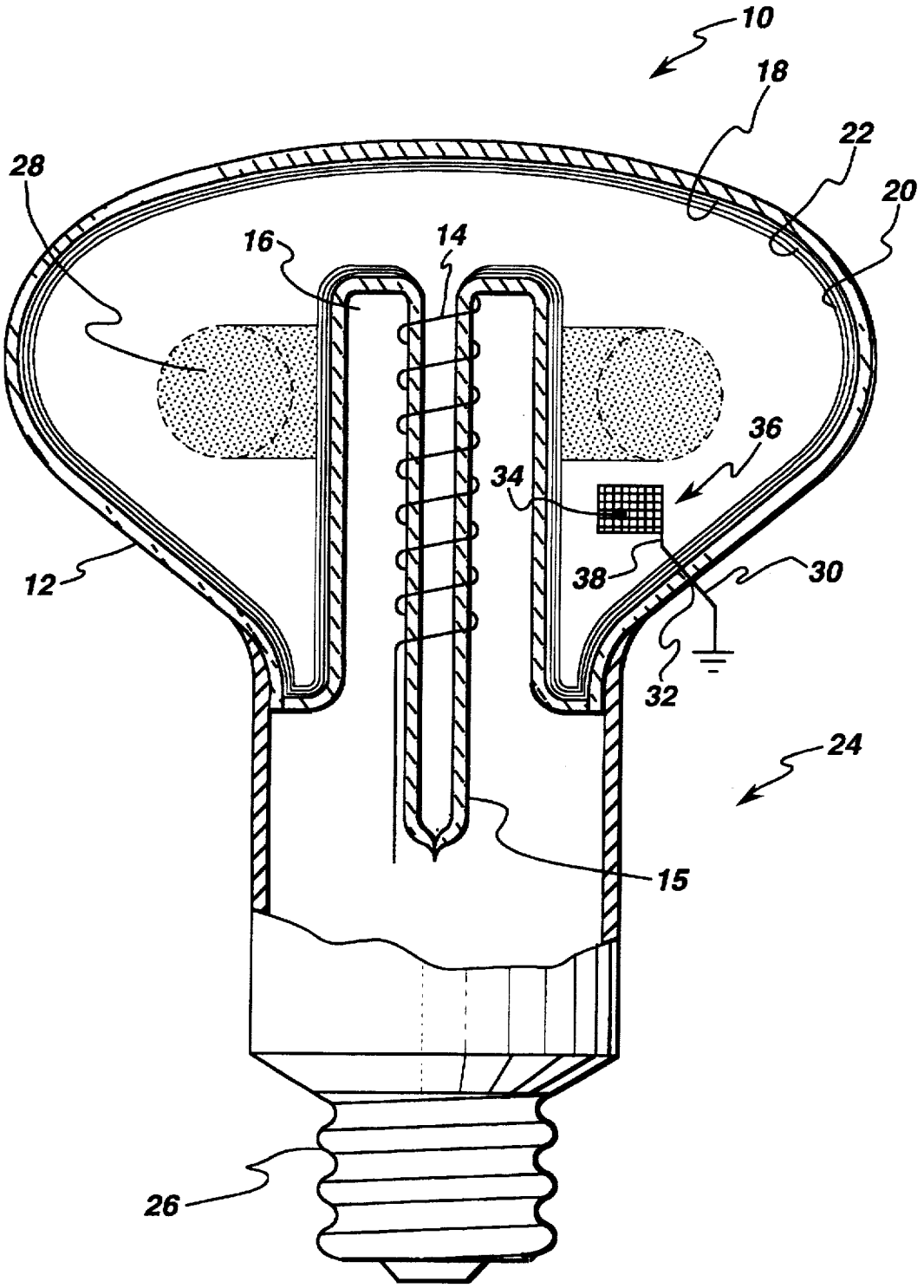
FIG. 2 illustrates, in partial cross section, an electrodeless fluorescent lamp having a feedthrough structure as shown in FIG. 1 which is also utilized for supporting an amalgam flag.

As illustrated in FIG. 2, feedthrough 30 is also useful for supporting an amalgam 34 in electrodeless fluorescent lamp 10. As illustrated, the amalgam is disposed on a "flag" 36 by impregnating or electroplating the flag with a metal or alloy capable of forming an amalgam with mercury. Exemplary configurations for an amalgam flag comprise a wire mesh or screen and a spiral-shaped wire.

Exemplary amalgams comprise a combination of bismuth and indium, pure indium, a combination of lead, bismuth and tin, and a combination of zinc, indium and tin. Each amalgam has its own optimum range of operating temperatures. Hence, the optimum position for a particular amalgam in the lamp depends on the optimum range of operating temperatures for the particular amalgam.

Amalgam flag 36 includes a stem portion 38 made of a metal which can be bent so as to allow for adjustment in position of the amalgam. The amalgam flag may be welded to the stem portion 38; or, alternatively, the amalgam flag may be folded about the stem portion 38 and crimped thereto. The position of the starting amalgam is optimized for achieving high light output quickly. (It is to be noted that although the description herein refers to a starting amalgam, electrodeless fluorescent lamps may also use a running amalgam, the position of which is optimized to maintain high light output during steady-state operation. A running amalgam is typically positioned near the coolest spot in the lamp; hence, feedthrough 30 would not be appropriate for supporting a running amalgam in the particular lamp configuration illustrated and described herein.)

In a preferred method of manufacture, the amalgam flag is attached to the feedthrough by spot welding or other suitable means after the envelope is coated with a phosphor, but before the re-entrant cavity is attached to the envelope. Advantageously, therefore, only the re-entrant cavity is required to fit through the opening in the bulb, as opposed to a combination of the bulb and the amalgam flag. As another advantage, this method allows for flexibility in optimal positioning of the amalgam within the lamp.

While the preferred embodiments of the present invention have been shown and described herein, it will be obvious that such embodiments are provided by way of example only. Numerous variations, changes and substitutions will occur to those of skill in the art without departing from the invention herein. Accordingly, it is intended that the invention be limited only by the spirit and scope of the appended claims.

What is claimed is:

1. An electrodeless discharge lamp, comprising:

a light-transmissive envelope containing an ionizable, gaseous fill for sustaining an arc discharge when subjected to an alternating magnetic field and for emitting radiation having a wavelength in a range from approximately 100 nm to approximately 1000 nm as a result thereof, said envelope having an EMI shield on the interior thereof, said EMI shield comprising an optically transparent, electrically conductive coating;

an excitation coil situated proximate said envelope for providing said alternating magnetic field when excited by an alternating current energy source;

a feedthrough member for directly connecting said EMI shield to a ground potential external to said envelope, said feedthrough member comprising a wire inserted through said envelope and sealed thereto, said wire comprising a material selected from a group consisting of platinum and a combination of platinum and rhodium.

2. The lamp of claim 1 wherein said coating comprises a material selected from a group consisting of fluoro-tin-oxide and indium-tin-oxide.

3. An electrodeless fluorescent lamp, comprising:

a light-transmissive envelope containing an ionizable, gaseous fill for sustaining an arc discharge when subjected to an alternating frequency magnetic field and for emitting radiation having a wavelength in a range from approximately 100 nm to approximately 1000 nm as a result thereof, said envelope having an EMI shield on the interior thereof, said EMI shield comprising an optically transparent, electrically conductive coating, said arc discharge emitting ultraviolet radiation when subjected to said alternating frequency magnetic field, said envelope having an interior phosphor coating for emitting visible radiation when excited by said ultraviolet radiation, said envelope further having a re-entrant cavity formed therein and attached thereto;

an excitation coil situated proximate said envelope for providing said alternating frequency magnetic field when excited by an alternating current energy source, said excitation coil being contained within said re-entrant cavity;

a feedthrough member for directly connecting said EMI shield to a ground potential external to said envelope, said feedthrough member comprising a wire sealed to said lamp, said feedthrough member inserted through and sealed to said lamp envelope before attachment of the re-entrant cavity thereto, said feedthrough member being situated in said envelope at a location other than where the re-entrant cavity is fitted and sealed to said envelope.

4. The lamp of claim 3 wherein said wire comprises a material selected from a group consisting of platinum and a combination of platinum and rhodium.

5. The lamp of claim 3, further comprising an amalgam support attached to said feedthrough member and situated within said envelope to support an amalgam which controls mercury vapor pressure in said lamp.

6. The lamp of claim 5 wherein said amalgam support comprises a flag member attached to a stem portion, said amalgam being disposed on said flag member.

7. A method for manufacturing an electrodeless fluorescent lamp of the type having a light-transmissive envelope with an interior phosphor coating for emitting visible radiation when excited by ultraviolet radiation, said envelope having a re-entrant cavity attached thereto for containing an excitation coil, said re-entrant cavity having an exhaust tube extending therethrough, said method comprising the steps of:

providing an opening in said envelope for a feedthrough member;

inserting said feedthrough member through said opening and sealing said feedthrough member to said envelope, said feedthrough member comprising a wire sealed to said lamp;

applying an EMI shield to the interior surface of said envelope, said EMI shield comprising an optically transparent, electrically conductive coating;

making contact between said EMI shield and said feedthrough member, said feedthrough member directly connecting said EMI shield to a ground potential external to said envelope and being situated in said envelope at a location other than where the re-entrant cavity is fitted and sealed to said envelope;

attaching said re-entrant cavity to said envelope; and evacuating said envelope.

8. The method of claim 7 wherein said coating comprises a material selected from a group consisting of fluoro-tin-oxide and indium-tin-oxide.

9. The method of claim 7, further comprising the step of attaching an amalgam support to said feedthrough member before attaching said re-entrant cavity to said envelope, said amalgam support being positioned for supporting an amalgam in said lamp for optimally controlling mercury vapor pressure therein.

10. The method of claim 7 wherein said wire comprises a material selected from a group consisting of platinum and a combination of platinum and rhodium.

* * * * *